US008220111B2

(12) United States Patent
Poliakoff

(10) Patent No.: US 8,220,111 B2
(45) Date of Patent: Jul. 17, 2012

(54) CUFFLINK FOR BUTTONED SHIRTS

(76) Inventor: Ephraim Poliakoff, Har Nof (IL)

( * ) Notice: Subject to any disclaimer, the term of this patent is extended or adjusted under 35 U.S.C. 154(b) by 1043 days.

(21) Appl. No.: 11/089,501

(22) Filed: Mar. 25, 2005

(65) Prior Publication Data

US 2006/0213035 A1 Sep. 28, 2006

(51) Int. Cl.
*A44B 5/00* (2006.01)

(52) U.S. Cl. ..... 24/102 PL; 24/102 R; 24/41.1

(58) Field of Classification Search ..... 24/46, 45, 24/41.1, 42, 43, 47, 44, 113 MP, 301, 102 R, 24/102 PL
See application file for complete search history.

(56) References Cited

U.S. PATENT DOCUMENTS 704,111 A * 7/1902 Roberts ..... 24/43
2,841,848 A * 7/1958 Smith ..... 24/41.1
4,528,726 A * 7/1985 Kurashima ..... 24/102 SL
5,195,216 A * 3/1993 Ishii ..... 24/18
5,621,951 A * 4/1997 Gould ..... 24/90.5
6,502,284 B2 * 1/2003 Juda et al. ..... 24/7
6,857,167 B2 * 2/2005 Bishop ..... 24/66.2

* cited by examiner

*Primary Examiner* — Robert J Sandy
(74) *Attorney, Agent, or Firm* — Katten Muchin Rosenman LLP

(57) ABSTRACT

A cufflink for a button shirt has an inner piece configured to be disposed on an inside of paired shirt sleeve cuffs, and an outer piece configured to be disposed on an outside of the paired shirt sleeve cuffs. At least one of the inner piece and the outer piece has a male portion preferably having a male engagement device thereon. An opposite one of the inner piece and the outer piece has a complementary female engagement device therein. The male engagement device and the female engagement device are configured to be releasably coupled to one another. Preferably, the male engagement device includes a pin configured to pass through the inner cuff button hole and then the outer cuff fabric before engaging the female engagement device. Preferably, the outer piece inner surface has a recess therein configured to encompass the shirt sleeve button.

14 Claims, 4 Drawing Sheets

CUFFLINK FOR BUTTONED SHIRTS

BACKGROUND OF THE INVENTION

1. Field of the Invention

The present invention relates to a cufflink that is designed to be attached to a non-cufflink style shirt, e.g., a buttoned cuff shirt sleeve (not a French-cuff shirt sleeve), that has a button hole at one end of the cuff and a button with no button hole at the other end of the cuff.

2. Related Art

Non-cufflink shirts typically have a button on one end of the cuff and a button hole on the other end. Because of the lack of a button hole on both ends, existing cufflinks are not usable on these shirts.

Prior known cufflinks consist of a decorative or ornamental piece that is often used as jewelry. The decorative piece contains a stem that protrudes from the piece. At the end opposite the decorative piece, the stem contains an engagement piece which typically consists of a short pole that is attached in its middle to the stem and swivels perpendicular to the stem. To engage the cuff, the short pole at the end of the stem is swiveled to a position that is at a right angle to the stem.

Such a design works well for a shirt that has pre-cut button holes on both ends of the cuff so that the stem can pass through the holes at both ends of the cuff. The engagement piece (the short pole at the end of the stem) then holds the cuff opposite the cuff on which the decorative piece resides by swiveling the short pole in a position that is at a right angel to the stem.

However, such designs cannot by used with a buttoned cuff shirt or any shirt that does not have button holes or cufflink holes at both ends of the cuff. It is impossible to attach a cufflink to such a shirt because the stem will not pass through the cuff at the buttoned end. Therefore, the known cufflinks cannot be used with any shirt other than one made specifically for traditional cufflinks, with holes in both ends of the cuff through which the stem may pass.

U.S. Pat. No. 4,539,731 issued to Franco Torrini on Sep. 10, 1988 shows a form of cufflink for use, in particular, with a shirt cuff button; however, it shows only a device that merely covers the existing button. This device simulates a cufflink, but it is not a cufflink. It provides only for a cover to a button, but does not provide a device which may be attached to a buttonless shirt cuff. It further does not provide for a manner in which the cufflink can attach to a shirt that is not designed for cufflinks.

Similarly, U.S. Pat. No. 5,490,309 issued to Galilea F. Velasquez and James R. Steier on Feb. 13, 1996, shows merely a fastener assembly that attaches fabric without the need of sewing. However, this device is neither decorative nor is it made specifically for shirt cuffs or for any type of decorative or ornamental use. Furthermore, the device shown includes two separate interlocking pieces and a locking device that permanently secures the male and female members on opposing sides of the fabric.

U.S. Pat. No. 6,618,908 issued to Lamb Brook on Sep. 16, 2003 describes a cufflink that can be attached to a casual shirt of a type comprising a cuff, a cuff button, and only one button hole. This device comprises a pair of legs joined by an attachment means. This device, however, requires the use of the button to anchor the device to the shirt cuff and to pull the cuff ends together. Thus, if the button is removed or missing, the device is not usable. Moreover, this device does not attach the cuffs in the same manner as a traditional cufflink.

Therefore, there is a need for a cufflink which may be used with a button shirt, with a buttonless shirt, and with a cufflink-type shirt, and which may be easily moved from shirt to shirt without difficult manipulations.

SUMMARY OF THE INVENTION

It is an object of the present invention to provide a novel cufflink that will be used primarily for non-cufflink type shirts, that is, shirts that have no button hole on one end of the shirt cuff.

According to a first aspect of the present invention, structure and/or steps are provided for a cufflink configured for use with a shirt cuff having a button. The structure and/or steps include a male piece having a male engagement member on an inner surface thereof. A female piece is also provided and has a female engagement member on an inner surface thereof. The female engagement member is configured to releasably engage the male engagement member. A hinge portion is provided and is configured to movably couple the male piece with respect to the female piece. At least one of the male piece and the female piece has a recess therein configured to enclose the shirt cuff button.

According to a second aspect of the present invention, a method of forming a cufflink includes the steps of: (a) forming a male piece having a fabric-piercing pin disposed on an inner surface thereof; (b) forming a female piece having (i) a button-encompassing recess formed on an inner surface thereof, (ii) a pin-accepting receptacle formed on the inner surface thereof, and (iii) an ornamental feature formed on an outer surface thereof; and (c) coupling together said male piece and said female piece with a hinge device.

According to a third aspect of the present invention, a method of coupling together paired shirt sleeve cuffs with a cufflink having a male piece with a pin and a female piece with a receptacle, includes the steps of: (i) placing the male piece pin through an inner one of the paired shirt sleeve cuffs; (ii) placing the male piece pin through an outer one of the paired shirt sleeve cuffs; and (iii) placing the male piece pin into the female piece receptacle.

BRIEF DESCRIPTION OF THE DRAWINGS

The advantageous structure and/or function according to the present invention will be more easily understood from the following detailed description of the preferred embodiments and the appended Drawings, as follows.

DETAILED DESCRIPTION OF THE PRESENTLY PREFERRED EXEMPLARY EMBODIMENTS

1. Introduction

The present invention will now be described with respect to several embodiments in which two hinged pieces are connected together through both ends of the shirt cuff. However, the present invention will find applicability in many other designs in which the two pieces are connected to the ends of the shirt cuff in a manner to replicate a standard cufflink.

As a brief overview, the present invention permits the use of a cufflink with any type of long-sleeved shirt, regardless of whether or not it has button holes or other holes in the cuff. This invention permits cufflinks to be used on shirts that are designed for buttons on the cuff, or where the buttons were removed or fell off. The cufflinks according to the present invention will be usable in such shirts because of a stem in the form of a pin that will pass through the fabric of the cuff (even a cuff without holes), and will attach to an engaging structure at the other cufflink piece.

The presently preferred embodiment comprises two rectangular pieces connected with a hinge. One or both of the outside surfaces are ornate and decorative, as jewelry or cufflinks. The inside surface of at least one of the pieces (preferably the piece with the female receptacle, as described below) is preferably recessed approximately two millimeters below the inside surface. This recess permits the piece to fit over the button (if any) of the shirt sleeve cuff.

At least one of the inside surfaces (preferably, the non-recessed or male piece) has a metal pin protrusion. The opposite surface, the recessed surface, will have a complementary female receptacle. The pin will pass through both ends of the shirt cuff to the female receptacle at the opposite surface. The male piece preferably has an engagement portion (or protuberance) at the end thereof which is configured to pass through a constricted opening at the female end, to secure the male piece to the female piece, unless they are pulled apart. Either or both of the male piece and the female constriction may have resilient flexible portions firmly fix the male piece to the female constriction. Of course, the pin may have no protuberance, and the receptacle may be designed with a tolerance tight enough to releasably engage the pin.

Alternatively, the male piece may have an engagement notch, hook, or series of protuberances that would pass through to the female receptacle; and the female surface may have a spring-lock mechanism or other device to catch and releasably engage the male engagement device. To release the male device, the user would squeeze a releasing mechanism (such as a spring catch) at the outer surface, thus releasing the male device.

Thus, the present invention will enable the wearer of a buttoned cuffed shirt to wear ornamental, decorative cufflinks with that shirt. This converts a buttoned down cuff to a cufflink shirt.

2. The Structure

Figure 1:
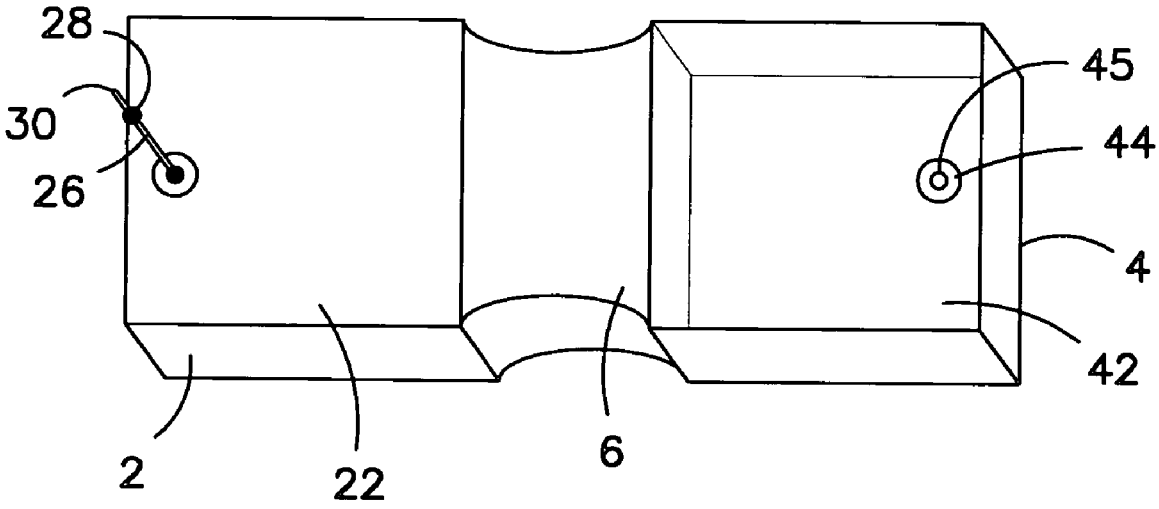
FIG. 1 is a schematic view of the inside of the cufflink according to the preferred embodiment of the present invention, showing the inner non-decorative side of each of the pieces.
Figure 3:
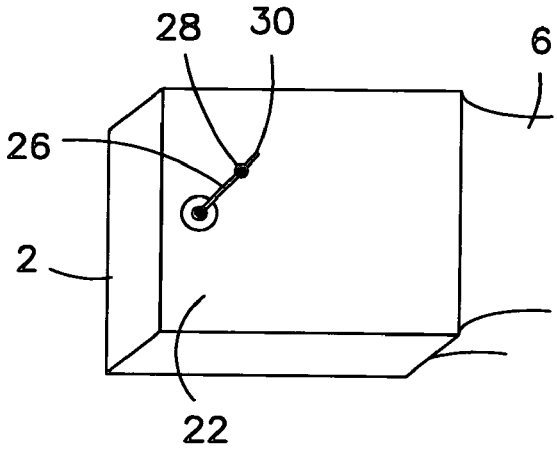
FIG. 3 is a schematic view of the inside of the FIG. 1 cufflink piece that contains the non-decorative side on the outside; this view shows the male pin stem. This view also shows the flexible joinder piece attached to and protruding from the side of the piece.
Figure 2:
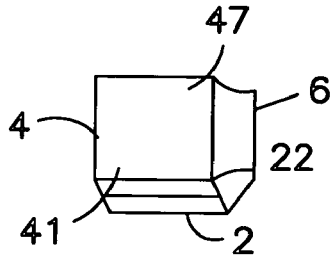
FIG. 2 is a schematic view of the outside of the FIG. 1 cufflink, with the decorative or ornamental side showing.
Figure 4:
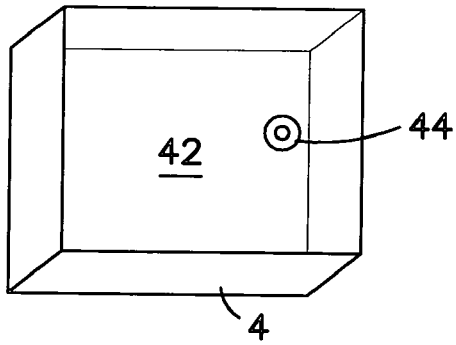
FIG. 4 is a schematic view of the inside of the FIG. 1 cufflink piece that is on the underside of the device and has the ornamental or decorative side on the outside. This view also shows the female receptacle for the male pin stem.
Figure 5:
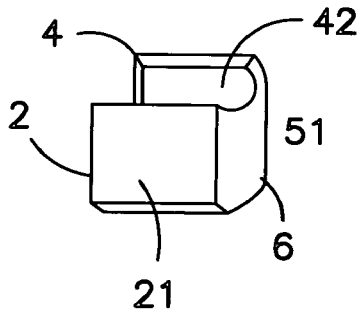
FIG. 5 is a schematic view of the FIG. 1 joinder piece that holds together the two sides of the cufflink.
Figure 6:
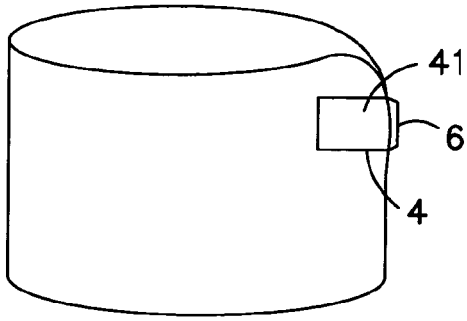
FIG. 6 is a schematic view of the FIG. 1 cufflink attached to a shirt cuff.
Figure 7:
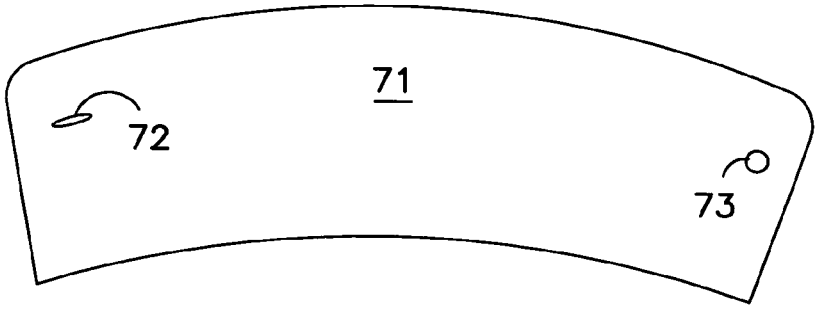
FIG. 7 is a schematic view of the outside of a shirt cuff with a button, to illustrate the placement of the cufflink in such a cuff.
Figure 8:
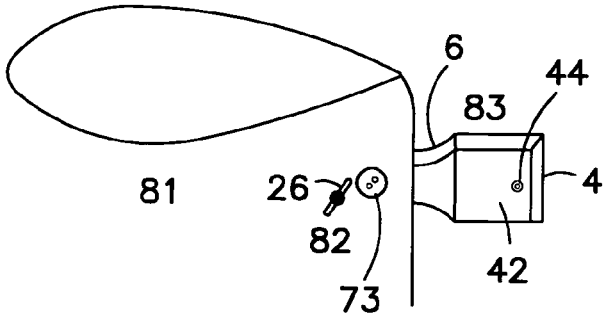
FIG. 8 is a schematic view of a shirt cuff with the cufflink pin stem inserted through and protruding from the fabric of the cuff.
Figure 9:
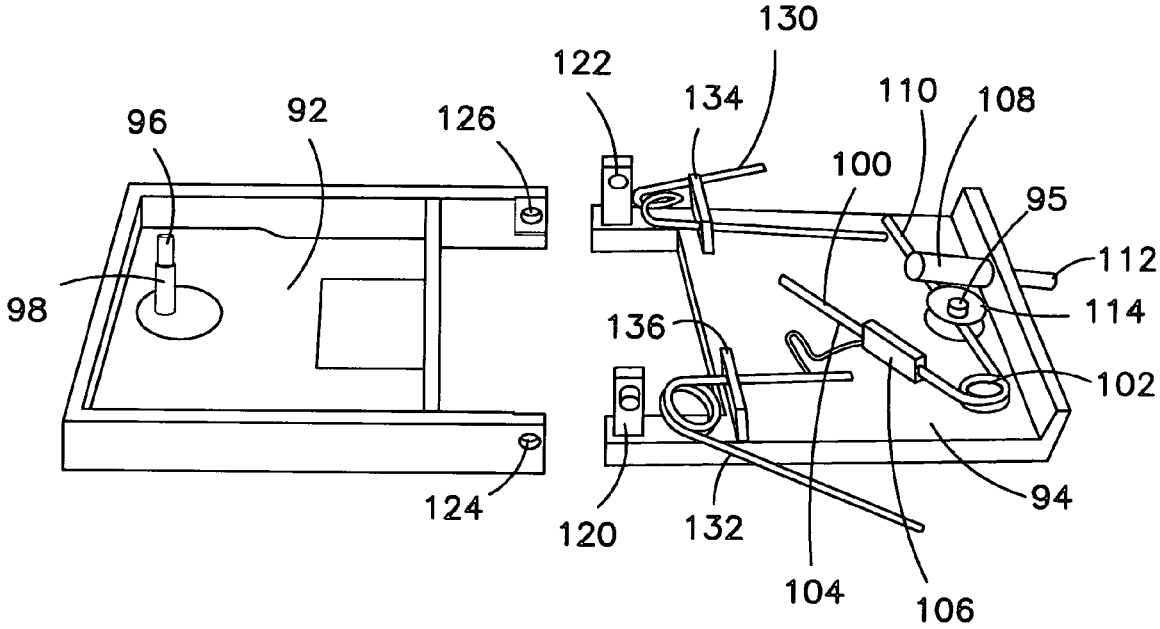
FIG. 9 is a schematic view of an alternative embodiment of the cufflink, wherein springs are used (i) to bias the two sides apart, and (ii) to hold the pin protrusion in the female receptacle.

FIG. 1 shows the device according to the preferred embodiment, in an open state, enabling one to view the inside surfaces thereof. FIG. 2 shows the device in a closed state, permitting one to view it as is would look either on a cuff or closed for storage. FIGS. 3 and 4 illustrate the two separate pieces of the device, while FIG. 5 highlights the connector for the two pieces. FIG. 6 demonstrates how the embodiment will lie on the shirt cuff when complete, and FIG. 7 is an illustration of the outside of a shirt cuff and the mechanics of the mechanics of the shirt cuff. FIG. 8 shows the embodiment being applied to the shirt cuff. FIG. 9 shows an embodiment with a spring-lock mechanism.

Referring to FIG. 1, a male piece 2 is joined to a female piece 4 with a hinge 6. Each of the male piece 2 and the female piece 4 may comprise a solid piece of metal, plastic, or similar hard material. The male piece 2 has an inner surface 22, and the female piece 4 has an inner surface 42. Each inner surface may comprise a smooth polished surface, but may also comprise abrasions or a roughened surface to enhance the engagement of the corresponding piece to the surface of the cloth cuff. The male piece 2 has an outer surface 21, and the female piece 4 has an outer surface 41. At least one of the outer surfaces 21, 41 is preferably an ornamental and/or decorative surface, similar any known cufflink. In the preferred embodiment, only the surface 41 includes ornamentation 47, such as diamonds, rubies, precious stones, metallic ornaments, gold, platinum, shiny metal, etc. Each of the male and female pieces is preferably approximately 1.6 cm long (side-to-side in FIG. 1) by 1.3 cm wide (top-to-bottom in FIG. 1). Of course, the actual sizes of the pieces will vary based on the size of the shirt on which it is to be worn. For example, a small boy's size cufflink will be smaller than a full size adult cufflink.

As shown in FIGS. 1 and 3, protruding from the inner surface 22 of the male piece 2, is a stem 26. Preferably, the stem is in the form of a metal and/or plastic pin with a protuberance 28 spaced slightly back from a distal end 30 thereof. The protuberance 28 preferably comprises a rubber, plastic, and/or metal rounded bulbous or elliptical shape which may plastically deform when passing through the female constriction in the female piece 4. The stem ideally is composed of a metal of the same composite material as the cufflink. The length of the stem is ideally 0.4 centimeter. The rounded bulbous or elliptical shape begins at the point that is 0.2 centimeters from the base of the stem and protrudes for 0.15 centimeters, ending at the point that is 0.3 centimeters from the base of the stem. The parameter of the rounded or elliptical protrusion extends 0.15 centimeter from the center out.

The stem 26 is configured with a sharpened end to penetrate first the button hole 72 of the shirt cuff (see FIG. 7), and then pass through the fabric of the other end of the shirt cuff in the vicinity of button 73, with the stem 26 emerging from the cloth adjacent to the button, as shown in FIG. 8. Should the user desire, however, the stem may pass through the fabric layers of both cuff ends.

As shown in FIGS. 1 and 4, the inside surface 42 of the female piece 4 is preferably recessed approximately 0.3 cm to enable it to cover the shirt button 73 (see FIG. 7). Of course, the inner surfaces of both the male piece 2 and the female piece 4 may be recessed, and both outer surfaces may be ornamented so that one cufflink configuration may be used for both left and right cufflinks. In addition, there is preferably a small metal or plastic mound 44 protruding from the floor of the inside surface 42 that contains a female receptacle 45 for the stem 26. The mound 44 may be integral with the inner surface 42 of female piece 4, or it may be a separate piece affixed thereto with solder, glue, etc. The female receptacle is composed of the same material as the remainder of the cufflink, and provides an opening of 0.1 centimeters. This facilitates the stem to pass through a tight opening that is 0.05 centimeters smaller than the rounded or elliptical protrusion of the stem, permitting the stem to pass through very tightly. Thus, the female receptacle will catch the protrusion of the stem and not permit the stem to slide out except through the use of intentional force. As a result, the stem will be secure in the female receptacle until the wearer intentionally and forcefully opens the cufflink to facilitate its release.

When the stem 26 closes, the female receptacle 45 in the mound 42 catches the pin protuberance 28 in its hole, thus engaging the male piece 2 with the female piece 4. One or both of the male protuberance 28 and the female receptacle 45 in mound 44 may comprise a resilient or elastic material such as rubber, plastic, biased metal pieces, etc, to repeatedly but securely engage the male and female pieces 2 and 4. Alternatively, the inner surface 42 of the female piece 4 may be non-recessed, but with a small circular receptacle recessed therein to accommodate the shirt cuff button. In this case, the mound 44 may comprise a small recessed receptacle in the inner surface 42.

The stem protuberance 28 near the top 30 of the stem is slightly wider than the rest of the stem. Preferably, the protuberance 28 resembles a tiny ball on or near the top of the stem 26. The purpose of this protuberance 28 is to lock and hold the 26 stem in the female receptacle of the mound 44. The female receptacle 45 is preferably a hole in mound 44 that is the same size (or slightly larger) than stem 26, but slightly smaller than the protuberance 28. The interior of the female receptacle may have a resilient or elastic material formed therein to engage the protuberance. When the protuberance 28 passes through the female receptacle hole, the hole catches and holds the pin stem by locking in the protuberance 28 by friction and/or the temporary plastic deformation of the protuberance 28 and/or female receptacle 45. The stem 26 can be removed by forcibly pulling the pieces 2 and 4 apart. The size of the protuberance 28 is configured to be sufficiently small that the stem 26 may pass through the fabric with only a slight impediment. Of course, there may be two, three, or four stems 26 on male piece 2, with corresponding female receptacles on the female piece 4. Also, the stems and receptacles may be place on the opposite male and female pieces, or mixed on different sides to enhance the connection of male piece 2 to female piece 4.

Male piece 2 and female piece 4 are held together by a flexible material hinge 6. This hinge may be of metallic, plastic, or similar flexible material, and may be permanently or removably affixed to the pieces 2 and 4. For example the hinge 2 may comprise a plurality of linked metal pieces. It is intended that the hinge will be composed of a pliable, twisted metal stem approximately 0.03 centimeter in diameter, curled and twisted into approximately four to six turns each of approximately 0.2 diameter. Each of the edges of the hinge would extend our straight, not twisted. The end of one side of the hinge would extend to, would be laid flat against and would be soldered to the base of the cufflink, while the other end of the hinge would extend to, would be laid flat against and would be soldered to the upper of ornamental flank of the cufflink. The hinge 6 is also illustrated in FIG. 2 and FIG. 5. This hinge allows a person the flexibility of putting the cufflink on with one hand; because of the hard flexible material used, a person can hold the device in place and snap shut the bottom cover (side 1B) with his thumb or other finger.

When the embodiment is attached to the shirt in the manner described above and shown in FIG. 6, it appears that the person is wearing a regular traditional cufflink.

3. Manufacture

A cufflink according to the present invention may be manufactured by techniques similar to those used in the manufacture of known cufflinks. That is, an outer piece may be provided with an ornamental outer surface, and a mound with a female receptacle placed on the inner surface thereof by molding, soldering, brazing, glue, etc. The mound may be molded or drilled with a receptacle therein. The receptacle may have a resilient material poured or otherwise formed therein.

The inner or male piece may be manufactured by processes similar to those described above, with the pin being molded, soldered, brazed, or glued on an inner surface. The protuberance may be formed by a drop of solder, rubber, epoxy, and/or plastic placed thereon. The most likely format for the stem is to solder a metal pin, approximately 0.4 centimeters, with a base of approximately 0.3 centimeters, to the non-ornamental side, or the underside, of the cufflink.

FIG. 9 shows a spring-lock embodiment wherein one spring is used to lock the stem into the female receptacle, and two other springs are used to bias the sides apart when the first spring is released. In more detail, the male piece 92 includes the stem 96 which has a detent 98 therein. The female piece 94 has a female receptacle 95, as discussed above. The female piece 94 also has a first spring 100 mounted on a spring post 102, and a first arm 104 of the spring 100 is retained on the female piece 94 by a spring retainer 106. A second arm 108 of the spring 100 is preferably retained in a slot 110 of the female receptacle 95. A release lever 112 is slidably mounted in a slot 114 in the female piece 94, and is configured to push the arm 110 of the spring 100 away from the female receptacle 95. In use, when the stem 96 is inserted into the female protrusion 95, the detent 98 is captured by the arm 110 of the spring 100, holding the male piece 92 closed against the female piece 94.

The female piece 94 also includes hinges 120 and 122 which are configured to couple with holes 124 and 126 in the male piece 92. Opening springs 130 and 132 are respectively coupled to spring retainers 134 and 136. These springs and spring retainers are arranged to bias the male piece 92 away from the female piece 94, so that when the lever 112 causes the spring arm 110 to release the stem 96 from the female receptacle 95, the cuff link easily opens.

Notable advantages of the present invention include:

- A cufflink that attaches to a shirt through a cuff that is not specifically designed with holes for cufflinks.
- A cufflink that attaches to a buttoned cuff shirt sleeve, which is not a formal or French-cuff shirt sleeve, that has a button hole at one end and a button with no button hole at the other end.
- A cufflink that attaches to a shirt designed for the cuff to be buttoned, but on which the button fell off or was removed. The cufflink attaches the two cuffs without the need for the button.
- A cufflink that comprises two rectangular pieces connected with a hinge or otherwise held together with a pliable metal or other material. The outside surfaces of both of the pieces are ornate and decorative, as jewelry or cufflinks.
- The inside surface of one of the decorative pieces has a metal stem that is inserted through the shirt cuff or button hole on one end of the cuff, and then penetrates the other end of the cuff on the non-holed, or buttoned, end.
- The stem may pass through both ends of the shirt cuff through to the second piece of the cufflink which contains a female receptacle at the opposite surface. The pin will have a protuberance at the end which would pass through a constricted opening at the female end, thus staying intact in the female end unless pulled open.

Alternatively, the male piece stem will have a protuberance that may pass through the shirt cuff cloth to the female surface. The female surface may have a spring-lock mechanism to catch the male protuberance. To release the male piece stem, the user may squeeze the catch at the outer surface, thus releasing the lock.

The inside surface of the piece with the female receptacle may be approximately two millimeters. The recess permits the piece to fit over the button of the shirt sleeve.

The purpose of the present invention is to enable the wearer of a buttoned cuffed shirt to wear ornamental, decorative cufflinks with any shirt. This converts a buttoned down cuff to a cufflink shirt.

4. Conclusion

Thus, what has been described is a novel cufflink design usable with shirts having no or only one cufflink hole.

The individual components shown in outline or designated by blocks in the attached Drawings are all well-known in the cufflink design arts, and their specific construction and operation are not critical to the operation or best mode for carrying out the invention.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

All U.S. and foreign patent documents discussed above are hereby incorporated by reference into the Detailed Description of the Preferred Embodiments.

What is claimed is:

1. A cufflink, comprising:

an inner piece configured to be disposed on an inside of a shirt cuff;

an outer piece configured to be disposed on an outside of a shirt cuff;

at least one of said inner piece and said outer piece having a male portion having a male engagement portion thereon, wherein the male engagement member has a length that is long enough to pass through both ends of a shirt cuff, an opposite one of said inner piece and said outer piece having a complementary female engagement device therein, said male engagement portion and said female engagement device being configured to releasably couple to one another;

at least one of said inner piece and said outer piece having a recess therein configured to encompass a shirt cuff button; and a hinge portion configured to movably couple said inner piece to said outer piece.

2. A cufflink according to claim 1, wherein said inner piece and said outer piece each comprise a metal, and wherein an outer surface of at least said outer piece comprises an ornamental surface.

3. A cufflink according to claim 2, wherein said male engagement portion comprises a protuberance disposed adjacent a distal end of a metal pin.

4. A cufflink according to claim 3, wherein said female engagement portion comprises a mound disposed on an inner surface thereof, and a receptacle therein configured to encompass said protuberance.

5. A cufflink according to claim 4, wherein at least one of said protuberance and said receptacle comprises a resilient material.

6. A cufflink according to claim 1, wherein said male portion comprises a plurality of metal pins, and wherein said female engagement device comprises a plurality of receptacles.

7. A cufflink according to claim 1, wherein said outer piece has an inner surface having said recess therein, and an outer surface having ornamentation thereon.

8. A cufflink according to claim 7, wherein said male piece, said female piece, said pin, and said receptacle each comprise a metal material.

9. A cufflink comprising:

a male piece configured to be disposed on an inside of paired shirt cuffs, said male piece having an inner surface with at least one pin affixed thereto, said at least one pin which has a length that is long enough to pass through the fabric of at least one paired shirt cuff;

a female piece configured to be disposed on an outside of the paired shirt cuffs, said female piece having a receptacle therein configured to releasably engage said male piece pin, said female piece having a recess in an inner surface thereof configured to encompass a shirt cuff button; and a hinge coupling said male piece and said female piece.

10. A cufflink according to claim 9, further comprising a protuberance adjacent a distal end of said pin, and wherein said receptacle has a resilient material disposed therein configured to releasably engage said protuberance.

11. A cufflink according to claim 9, wherein said hinge comprises linked metal pieces.

12. A cufflink according to claim 9, wherein the entire inner surface of said female piece is recessed to encompass the shirt cuff button.

13. A cufflink according to claim 9, further comprising a spring configured to releasably hold the male piece pin in the female piece receptacle.

14. A cufflink comprising:

a male piece configured to be disposed on an inside of paired shirt cuffs, said male piece having an inner surface with at least one pin affixed thereto, said at least one pin being configured to pass through the fabric of at least one of the paired shirt cuffs;

a female piece configured to be disposed on an outside of the paired shirt cuffs, said female piece having a receptacle therein configured to releasably engage said male piece pin, said female piece having a recess in an inner surface thereof configured to encompass a shirt cuff button; and a hinge coupling said male piece and said female piece wherein the cufflink further comprises a spring configured to releasably hold the male piece pin in the female piece receptacle and another spring configured to bias the male piece away from the female piece when said spring releases the male piece pin from the female piece receptacle.

* * * * *